US005315857A

United States Patent [19]

Bakermans et al.

[11] Patent Number: 5,315,857

[45] Date of Patent: May 31, 1994

[54] STAMPING AND FORMING MACHINE HAVING IMPROVED COUPLINGS

[75] Inventors: Johannes C. W. Bakermans, Harrisburg; Robert B. Gingrich, Elizabethtown, both of Pa.

[73] Assignee: The Whitaker Corporation, Wilmington, Del.

[21] Appl. No.: 915,799

[22] Filed: Jul. 16, 1992

[51] Int. Cl.[5] ..... B21D 37/04; B21J 9/18

[52] U.S. Cl. ..... 72/450; 72/402; 83/622; 83/628

[58] Field of Search ..... 83/602, 620, 622, 628; 100/280, 281, 282; 72/450, 402, 452, 431

[56] References Cited

U.S. PATENT DOCUMENTS 3,602,078 8/1971 Schindler ..... 83/622
3,886,829 6/1975 Criblez ..... 83/628
4,195,564 4/1980 Shiokawa ..... 83/628
4,497,196 2/1985 Bakermans et al. ..... 72/405
4,819,476 4/1989 Bakermans et al. ..... 72/450

*Primary Examiner*—David Jones

[57] ABSTRACT

Compressive force transmitting coupling (64) between an actuator (16), which oscillates along an arcuate path and a ram block (12) which reciprocates along a straight line path comprises first and second compression blocks (66, 68) and a bearing (70) between the compression blocks (66, 68). The compression blocks are in alignment and in compressive engagement with the ram block (12) and actuator (16). The compression blocks have opposed concave cylindrical bearing surfaces (72, 73) and the bearing (70) has oppositely facing convex bearing surfaces (74, 75) which are complementary to the concave surfaces (72, 73) of the blocks (66, 68).

19 Claims, 5 Drawing Sheets

STAMPING AND FORMING MACHINE HAVING IMPROVED COUPLINGS

FIELD OF THE INVENTION

This invention relates to stamping and forming machines of the type having opposed ram assemblies which move relatively towards and away from each other. The invention is particularly concerned with the couplings between the ram assemblies and the actuators.

BACKGROUND OF THE INVENTION

U.S. Pat. No. 4,497,196 describes a stamping and forming machine for performing operations on strip material, which has opposed ram blocks that move towards and away from each other along horizontal paths of reciprocation. The strip material is fed along a strip feed path which extends between the ram assemblies. The ram blocks are reciprocated by levers that are pivoted at their ends and which oscillate along arcuate paths.

The couplings between the ram blocks, which reciprocate along straight line paths, and the levers which oscillate along arcuate paths, must be such that the vertical movement of the levers is accommodated during operation of the machine. In the past, the levers have been coupled to the ram blocks by ball and socket joints. These ball and socket couplings have in general proved satisfactory excepting for the fact that they tend to wear out and require replacement at intervals which are more frequent than would be desirable. The present invention is directed to the achievement of an improved coupling for a stamping and forming machine of the type described above which will have a significantly longer life than the ball and socket couplings which have been used previously.

THE INVENTION

The invention comprises a coupling between an actuator, which oscillates along an arcuate path in a plane of oscillation, and a ram block which reciprocates along a straight line path between forward and retracted positions. The coupling comprises a compressive force transmitting means and a tensile force transmitting means. The coupling is characterized in that the compressive force transmitting means comprises first and second compression blocks and a bearing. The first and second compression blocks are in alignment and in compressive engagement with the ram blocks and the actuator respectively. The compression blocks have opposed compression block surfaces between which the bearing is located. The opposed surfaces are cylindrical and have spaced apart parallel cylinder axes which extend normally of the path of reciprocation of the ram block and normally of the plane of oscillation of the actuator. The bearing has first and second cylindrical bearing surfaces which are against, and are complementary to, the cylindrical compression block surfaces. During an operating cycle the first compression block will oscillate about the cylinder axis of its cylindrical surface. The compression block surfaces may be either concave or convex and the bearing surfaces will have an opposite curvature.

THE DRAWING FIGURES

THE DISCLOSED EMBODIMENT

Figure 1:
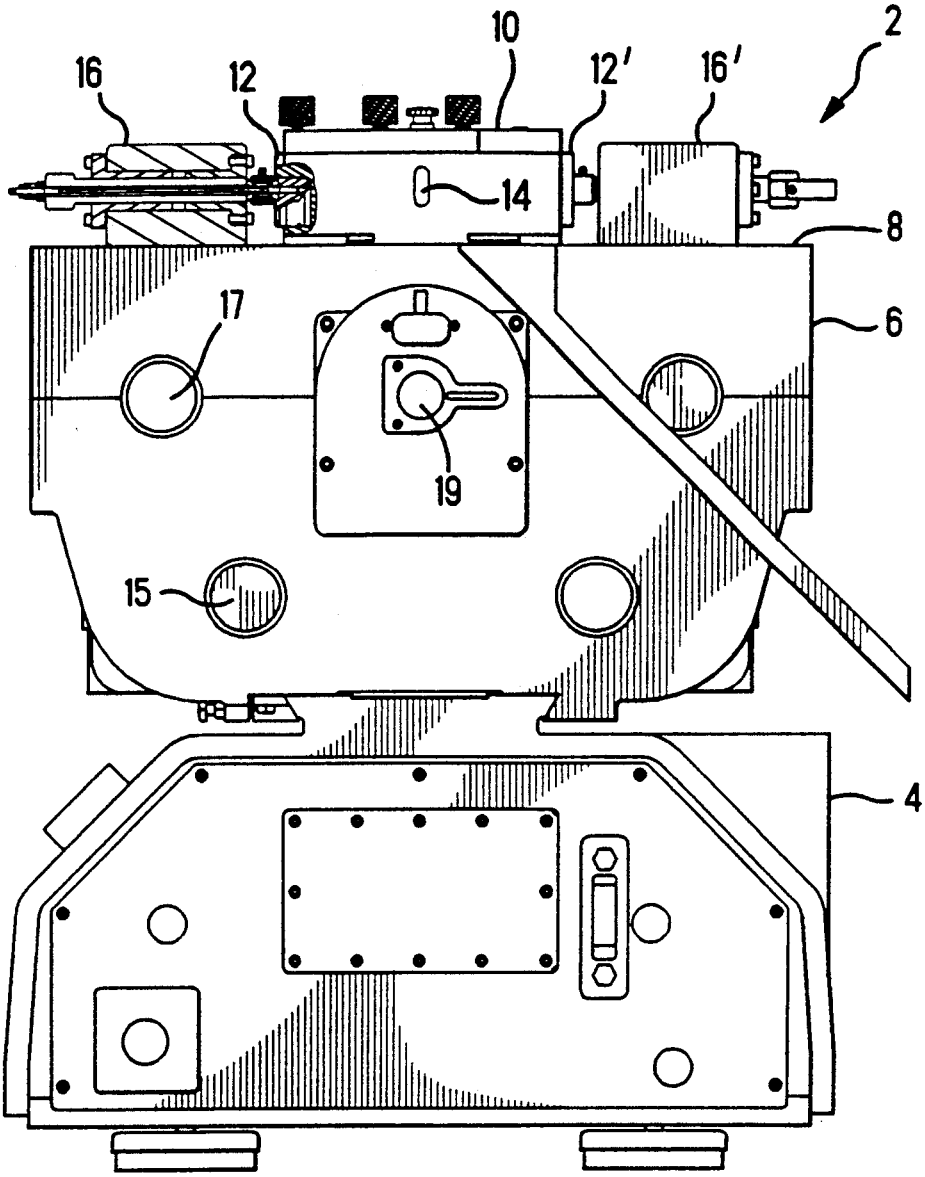
FIG. 1 is an end view of a stamping and forming machine.

FIG. 1 is an end view of a stamping and forming machine 2 of the type described in U.S. Pat. No. 4,497,196. Machines of this types comprise a base 4 having one or more stamping and forming modules 6 mounted thereon. Each module comprises a housing having an upper surface 8 which supports a ram housing 10 having a rectangular passageway extending therethrough. Opposed ram blocks 12, 12' are slidably contained in the housing and have tooling on their ends for performing operations on strip material which is fed through slots 14, in the sides of the housing 10. The rams 12, 12' are reciprocated by levers having upper ends 16, 16' to which the rams are coupled in a manner described below. Each lever is pivoted at its lower end on an axis 15 and is coupled intermediate its ends at 17 to a shaft 19. The upper end 16, 16' of each lever thus oscillates along an arcuate path while the ram blocks 12, 12' move along straight line paths in the housing 10. In the description which follows, only the lever and coupling on the left hand side of the machine will be described.

The upper end portion of the lever 16 has a bore 18 extending therethrough from its left hand side 20 to its right hand side 22. This bore is counterbored on its right hand side at 24 and a fixed sleeve 26 is secured in the bore and counterbore by fasteners 28. An adjustable sleeve 30 extends into the bore from the left hand side but is not fixed to the lever. The sleeve 30 has a flange 32 and screws 34 extend through this flange and bear against the surface 20 of the lever.

The interior surfaces of the sleeves 26,30 are threaded and a hollow adjusting tube 36 having threads on its external surface extends through the sleeves and is in threaded engagement with the sleeves. The left hand end 37 of this tube is enlarged and is non-circular so that it can be turned with a wrench.

The tensile force transmitting means, which pulls the ram block 12 leftwardly from its forward position to its retracted position, comprises a cable 42 which extends through the hollow interior 40 of the tube 36 and which has ferrules 44, 52 on its ends 41, 43. The ferrule 44 on the second end of the cable is crimped onto the cable and has a non-circular portion 46 so that it can be rotated with a wrench. The end portion 48 of ferrule 44 is threaded and extends into a threaded opening in an adaptor 50 which is secured in the ram block 12.

The left hand ferrule 52 is crimped onto the first end 41 of cable 48 and has a non-circular end 54 so that it also can be turned with a wrench or held against rotation. The intermediate portion of the ferrule 52 is threaded at 56 for the reception of lock nuts 62.

A loose spacer sleeve 58 surrounds the ferrule and spring washers 60 are confined between the end of the enlarged portion 37 of the sleeve and a flange on the end of the loose sleeve 58. Lock nuts 62 threaded onto the threaded portion of the ferrule to clamp the spring washers 60 against the end of the tube 36. The spring washers act as shock absorbers when lever 16 moves leftwardly and the cable 42 pulls the ram block 12 from its forward position to its retracted position.

Figure 2:
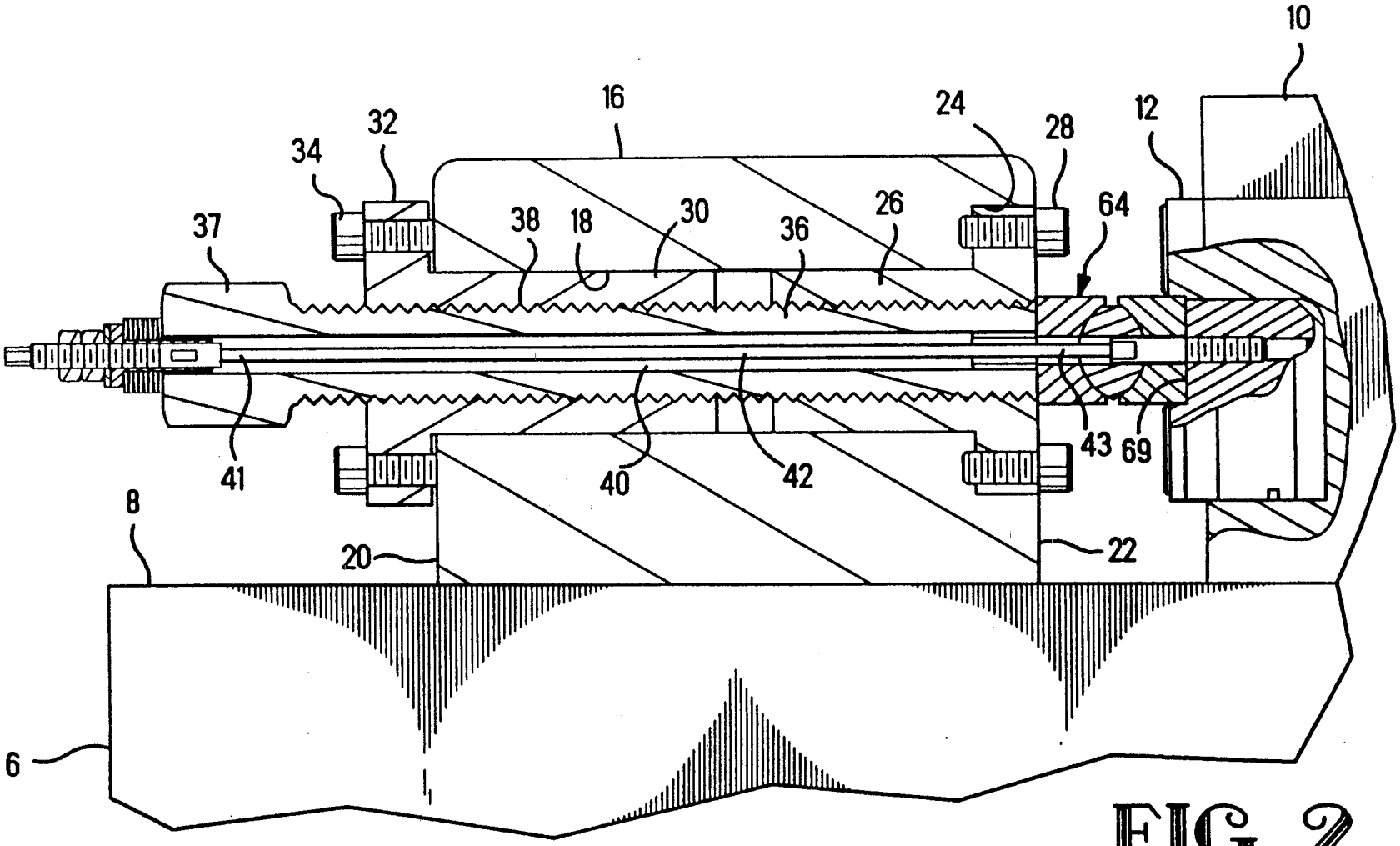
FIG. 2 is a view, on an enlarged scale, showing the upper portion of the actuator lever and the manner in which it is coupled to the ram block.
Figure 3:
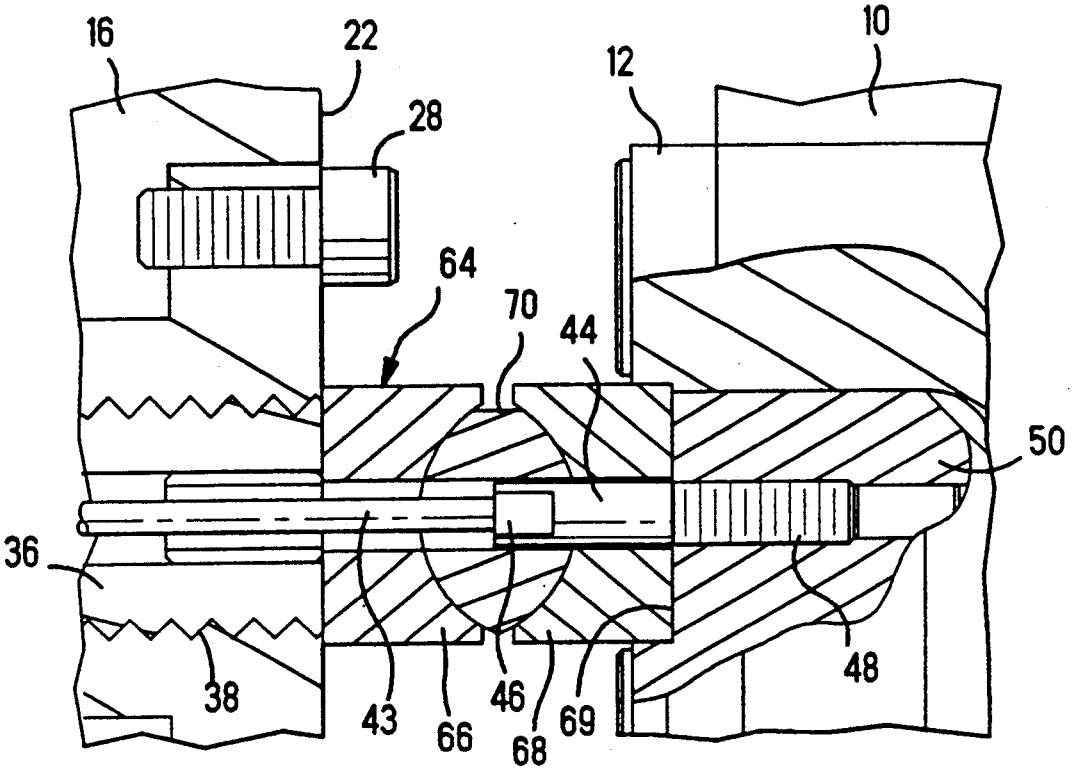
FIG. 3 is a view showing the right hand portion of the cable which functions as a tensile force transmitting means.
Figure 4:
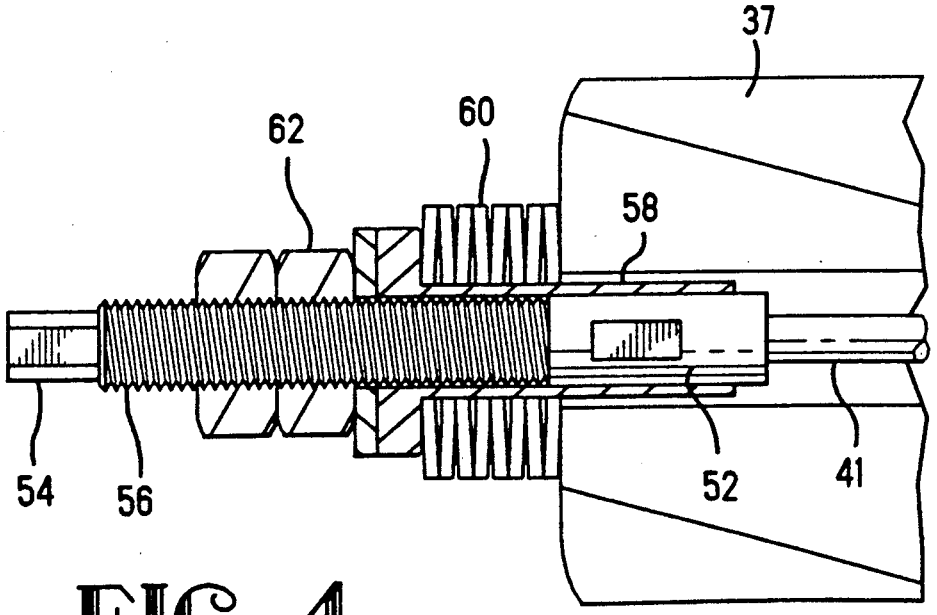
FIG. 4 is a view of the left hand portion of the cable and the guide sleeve which is mounted in the actuator lever.
Figure 5:
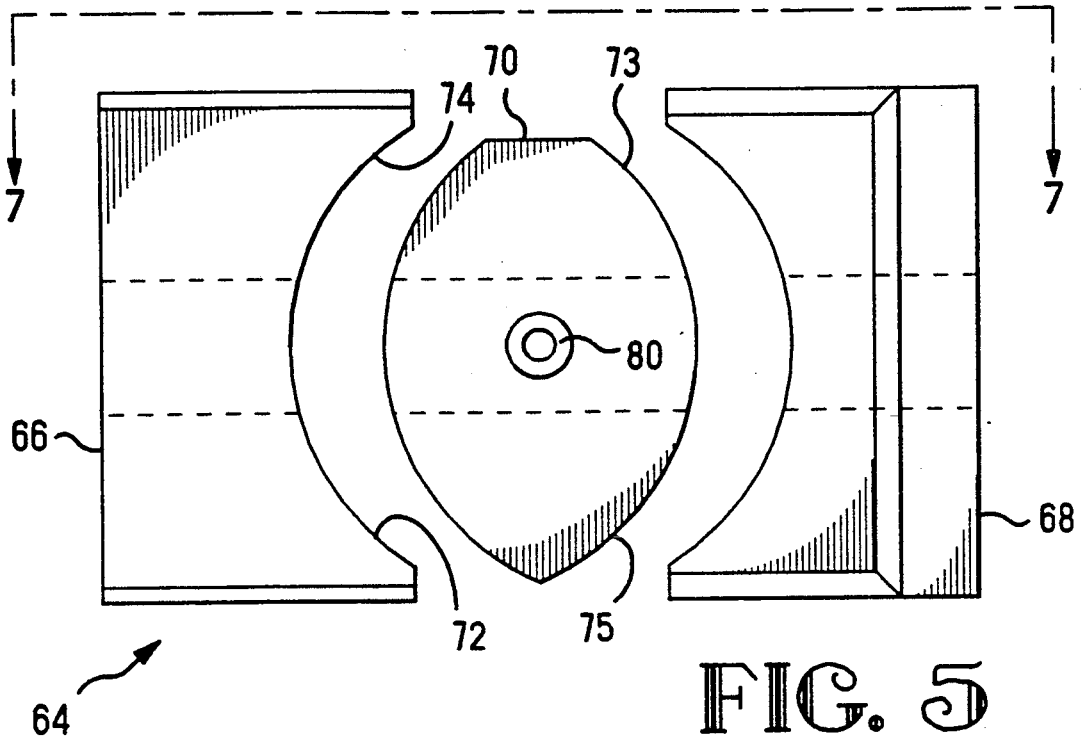
FIG. 5 is a side view of the compressive force transmitting means with the parts exploded form each other.
Figure 6:
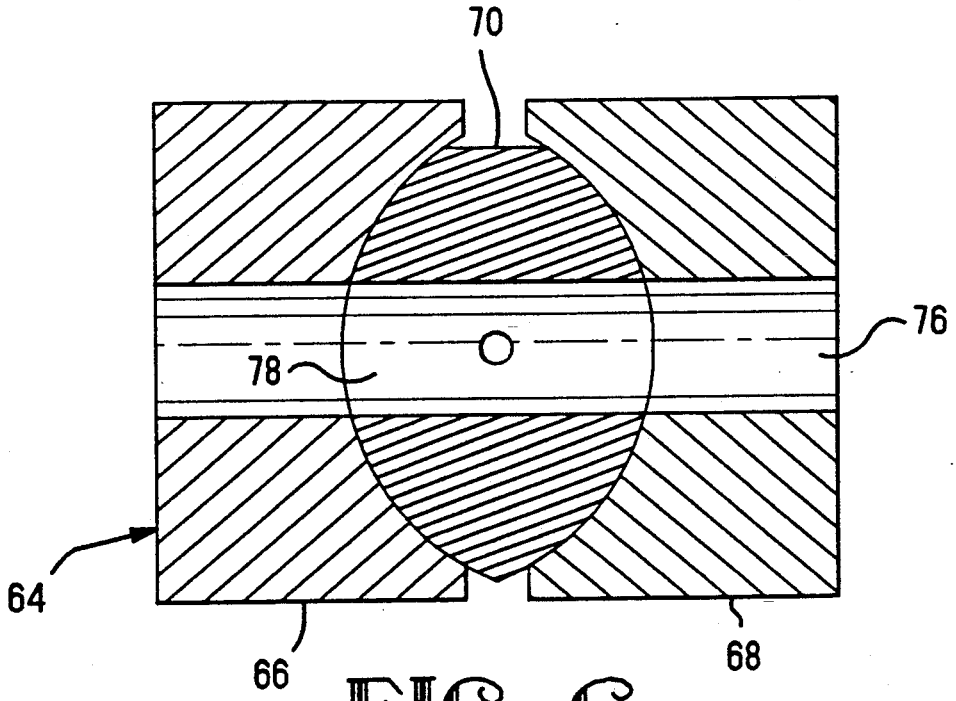
FIG. 6 is a sectional view which illustrates the lubricating passageways in the bearing.
Figure 7:
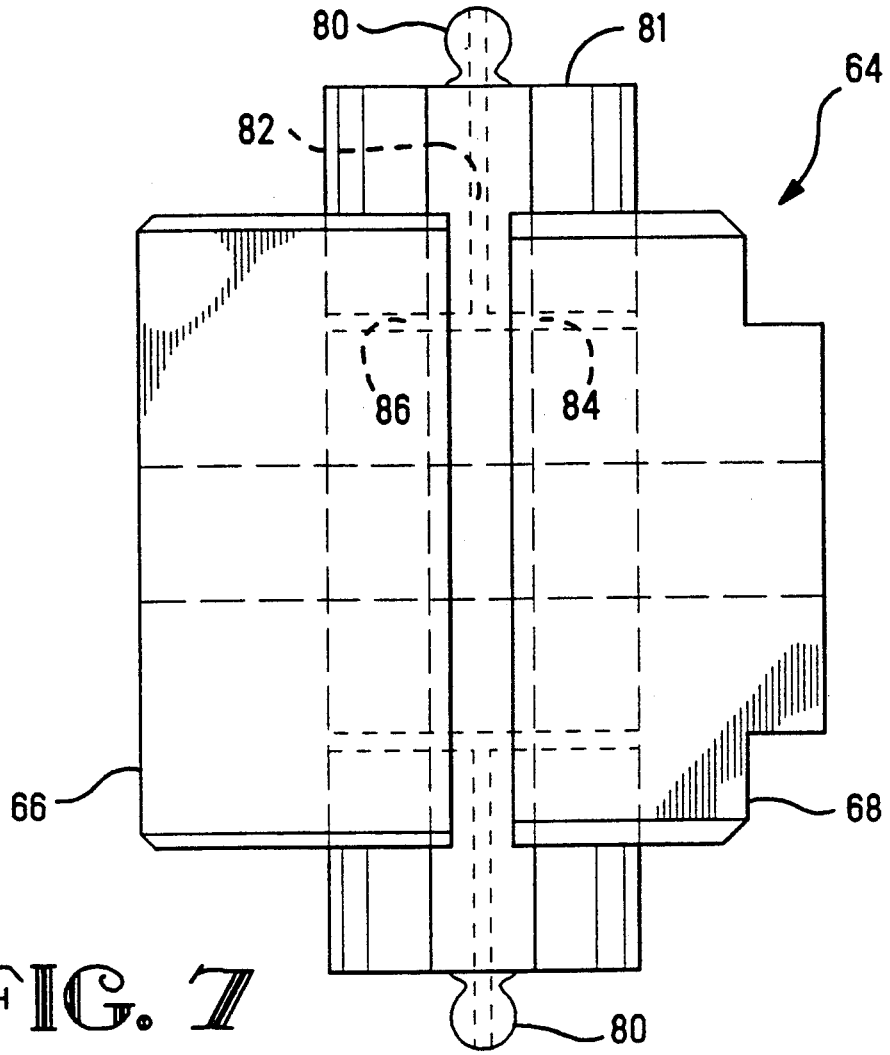
FIG. 7 is a view looking in the direction of the arrows 7—7 in FIG. 5.

The compressive force transmitting means 64 of the coupling comprises first and second compression blocks 66, 68 and a bearing 70. The first compression block is against the end of tube 36. The second block is received in a recess 69 in the adaptor 50 and the bearing is between the opposed surfaces 72, 73 of the blocks. The opposed surfaces 72, 73 are cylindrical concave surfaces and the oppositely facing bearing surfaces 74, 75 of the bearing 70 are complimentary convex cylindrical surfaces. The axes of all of these cylindrical surfaces extend horizontally, as viewed in FIG. 2, perpendicular to the path of reciprocation of the ram block, and perpendicular to the plane of oscillation of the upper portion 16 of the actuator lever. The compression blocks and the bearing have axial openings 76, 78 through which the cable and portions of the ferrule 44 extend.

Lubrication for the surfaces 72, 74 73, 75 is provided by the means of fittings 80 on the ends 81 of the bearing 70. These fittings communicate with passageways 82, 84, 86 which extend laterally to the convex bearing surfaces 74, 75. Channels in the convex bearing surfaces of the bearing extend to the axial openings 76, 78 so that lubricant can flow from the fittings 80 to the surfaces and lubricate the opposed bearing surfaces of the compression blocks and the bearing. The flow of lubricant is helped by the fact that when cable 42 pulls the ram block 12 leftwardly to its retracted position, surfaces 72, 74 and surfaces 73, 75 are separated by a slight amount, no more than about 0.003 mm. This separation permits the lubricant to flow over the surfaces. The blocks 66, 68 and the bearing 70 are clamped between the side 22 of the upper end 16 of the lever and the ram block 12. The block 68 cannot move relative to the ram block 12 and the block 66 cannot move relative to the surface 22. The compression block 68 moves along a straight line path during each operating cycle and the compression block 66 moves along an arcuate path. The bearing 70 oscillates in order to accommodate these movements of the compression blocks. In addition to its oscillatory movement, bearing block 70 moves vertically up and down during each cycle of operation. This vertical movement of bearing 70 results from the fact that surface 74 on the bearing tends to follow surface 72 of block 66.

Existing machines of the type shown in FIG. 1 have levers which are about 30 inches (762 mm) long; in other words, the distance between the pivotal axes 15 of the levers and their upper ends 16, 16' is about 762 mm. The stroke of each ram block 12 is 10.16 mm. the arc through which the upper end of the lever travels is only about 0.7 degrees and the vertical component of the movement of the end of the lever 16 is only about 0.1 mm. The distance of the compression block 66 moves relative to the surface 74 of the bearing 70 is very slight.

The very slight vertical movement of the upper end of the lever relative to the axis of the ram block resulted in a limited life of the ball and socket type couplings previously used in the type machines shown in FIG. 1. It has been found that couplings of the type shown in the present invention have a greatly extended life as compared with ball and socket couplings. The primary reason for the improved result is that with a ball and socket coupling, only a small portion of the bearing areas serve to transmit the force of the lever to the ram block. The coupling 64 of the present invention has cylindrical bearing surfaces 72, 74, 75, and 73. The entire areas of these surfaces are load bearing surfaces.

The system shown of having a separate tensile force transmitting system also permits adjustment of the limits of the stroke of the ram block. When it is desired to change the limit of the stroke of the ram block, the adjusted nuts 62 are unthreaded from the end of the ferrule 52 and the tube 36 is rotated by means of a wrench applied to the enlarged end 37 of the tube. Depending on the direction of rotation, the tube will be moved rightwardly or leftwardly as viewed in FIG. 2. After the desired adjustment has been made, the nuts 62 are threaded onto the end of the ferrule 52 to clamp the spring washers 50 against the end of the tube.

Figure 8:
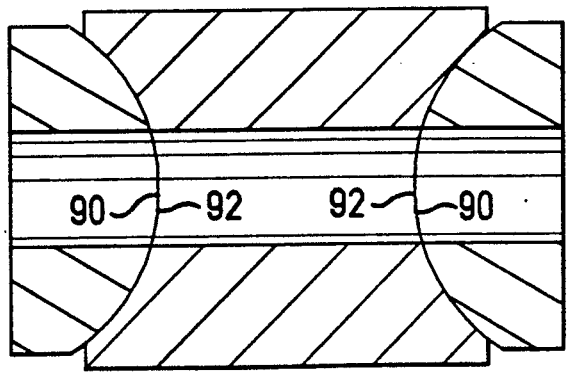
FIG. 8 is a side sectional view of an alternative embodiment.

FIG. 8 shows an alternative embodiment having compression blocks which have convex surfaces 92 and a bearing which has a concave surface 90. This embodiment functions in the same manner as the embodiment previously described.

The principal advantage of the invention is that compression blocks 66, 68 and bearing 70 have cylindrical surfaces 72, 74, 73, 75. As a result, the life of the coupling is significantly greater than the life of previously used ball and socket couplings.

We claim:

1. A coupling between an actuator, which oscillates along an arcuate path in a plane of oscillation, and a ram block which reciprocates along a rectilinear path between forward and retracted positions, the coupling comprising a compressive force transmitting means and tensile force transmitting means, the coupling being characterized in that:

the compressive force transmitting means comprises first and second compression blocks and a bearing, the first and second compression blocks being in alignment and in compressive engagement with the ram block and the actuator respectively, the compression blocks having opposed compression block surfaces, the bearing being between the opposed surfaces, the opposed surfaces being cylindrical and having spaced apart parallel cylinder axes which extend normally of the rectilinear path and normally of the plane of oscillation, the bearing having first and second cylindrical bearing surfaces which are against, and are complementary to, the cylindrical compression block surfaces whereby, during an operating cycle, in which the actuator oscillates along the arcuate path and the ram block reciprocates along the rectilinear path, the first compression block will oscillate about the cylinder axis of its cylindrical surface.

2. A coupling as set forth in claim 1 characterized in that the compression block surfaces are concave and the bearing surfaces are convex.

3. A coupling as set forth in claim 1 characterized in that the compression block surfaces are convex and the bearing surfaces are concave.

4. A coupling as set forth in claim 2 characterized in that the tensile force transmitting means is a cable having first and second cable ends, the first cable end being secured to the ram block, the compression blocks and the bearing having aligned openings which are in substantial axial alignment with the axis of the ram block, the cable extending through the openings.

5. A coupling as set forth in claim 4 characterized in that the bearing has oppositely facing end surfaces which extend normally of the cylindrical bearing surfaces, each of the end surfaces having a lubricant inlet passageway extending therein, each of the inlet passageways communicating with the lubricant distribution passageways which extend to the cylindrical bearing surfaces whereby lubricant can be caused to flow to the opposed bearing block surfaces and to the aligned openings.

6. A coupling between a lever which oscillates along an arcuate path, and a ram block which reciprocates along an rectilinear path between forward and retracted positions, the coupling comprising a compressive force transmitting means and a tensile force transmitting means which comprises a cable, the coupling being characterized in that the compressive force transmitting means comprises first and second compression blocks and a bearing, the first and second compression blocks being in alignment and against the ram block and lever respectively, the compression blocks having opposed compression block surfaces, the bearing being between the opposed surfaces, the opposed surfaces being cylindrical and having spaced apart cylinder axes which extend normally of the rectilinear path and normally of the plane of oscillation, the bearing having first and second oppositely facing cylindrical bearing block surfaces which are against, and are complimentary to, the opposed compression block surfaces, the bearing and the compression blocks having aligned openings extending therethrough, the cable having first and second ends, the first end being connected to the lever, the cable extending through the aligned openings, the second end being connected to the ram block whereby, during an operating cycle, in which the lever oscillates along the arcuate path and the ram block reciprocates along the rectilinear path, the first compression block will oscillate about its cylinder axis.

7. A coupling as set forth in claim 6 characterized in that the opposed compression block surfaces are concave and the bearing block surfaces are convex.

8. A coupling as set forth in claim 6 characterized in that the opposed compression block surfaces are convex and the bearing block surfaces are concave.

9. A coupling as set forth in claim 6 characterized in that the lever has an opening extending therethrough which is in alignment with the aligned openings in the bearing and the compression blocks, the cable extending through the opening in the lever and being adjustably connected to the lever thereby to permit adjustment of the forward and retracted positions of the ram block.

10. A coupling as set forth in claim 6 characterized in that the second compression block and the ram block have integrated portions which restrain the second compression block against oscillation relative to the ram block.

11. A coupling as set forth in claim 10 characterized in that the integrated portions comprise a recess in the ram block and portions of the second compression block which extend into the recess.

12. A coupling as set forth in claim 9 characterized in that an adjusting tube is provided in the opening in the lever, the adjusting tube being axially adjustable relative to the lever, the cable extending through the tube, the first end of the cable being secured to the adjusting tube whereby adjustment of the forward and retracted positions of the ram block is achieved by adjusting the position of the adjusting tube in the opening.

13. A coupling as set forth in claim 12 characterized in that the adjusting tube is threaded into the opening in the lever.

14. A coupling as set forth in claim 13 characterized in that at least one sleeve is fitted in the opening in the lever, the sleeve having a threaded opening extending therethrough, the tube having threads on its external surface.

15. A stamping and forming machine comprising a pair of opposed ram blocks which are reciprocable towards and away from each other between forward and retracted positions, strip feeding means for feeding strip material along a strip feed path which extends between the ram blocks, the ram blocks having tooling on their opposed ends for performing operations on the strip material, an actuator for each of the ram blocks comprising a lever which oscillates along an arcuate path, and a coupling between each of the levers and each of the ram blocks, each of the levers being coupled to its associated ram block by a compressive force transmitting means and a tensile force transmitting means, the machine being characterized in that:

the compressive force transmitting means comprises first and second compression blocks and a bearing, the first and second compression blocks being in alignment and in compressive engagement with the ram block and the actuator respectively, the compression blocks having opposed compression block surfaces, the bearing being between the opposed surfaces, the opposed surfaces being cylindrical and having spaced apart parallel cylinder axes which extend normally of the rectilinear path and normally of the plane of oscillation, the bearing having first and second cylindrical bearing surfaces which are against, and are complementary to, the cylindrical compression block surfaces whereby, during an operating cycle, in which the lever oscillates along the arcuate path and the ram block reciprocates along the rectilinear path, the first compression block will oscillate about the cylinder axis of its cylindrical surface.

16. A coupling as set forth in claim 15 characterized in that the compression block surfaces are concave and the bearing surfaces are convex.

17. A coupling as set forth in claim 15 characterized in that the compression block surfaces are convex and the bearing surfaces are concave.

18. A coupling as set forth in claim 16 characterized in that the tensile force transmitting means is a cable having first and second cable ends, the first cable end being secured to the ram block, the compression blocks and the bearing having aligned openings which are in substantial axial alignment with the axis of the ram block, the cable extending through the openings.

19. A coupling as set forth in claim 18 characterized in that the bearing has oppositely facing end surfaces which extend normally of the cylindrical bearing surfaces, each of the end surfaces having a lubricant inlet passageway extending therein, each of the inlet passageways communicating with the lubricant distribution passageways which extend to the cylindrical bearing surfaces whereby lubricant can be caused to flow to the opposed bearing block surfaces and to the aligned openings.

* * * * *